US006702491B2

(12) United States Patent
Kobayashi

(10) Patent No.: US 6,702,491 B2
(45) Date of Patent: Mar. 9, 2004

(54) FILM TRANSFER APPARATUS

(75) Inventor: Kenji Kobayashi, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 15 days.

(21) Appl. No.: 10/223,436

(22) Filed: Aug. 20, 2002

(65) Prior Publication Data

US 2003/0044212 A1 Mar. 6, 2003

(30) Foreign Application Priority Data

Aug. 20, 2001 (JP) ..... 2001-249348

(51) Int. Cl.[7] ..... B41J 33/518
(52) U.S. Cl. ..... 400/218; 400/695; 400/207
(58) Field of Search ..... 400/679, 695, 400/696, 207, 208, 218–222

(56) References Cited

U.S. PATENT DOCUMENTS 4,718,971 A * 1/1988 Summers ..... 156/540
5,785,437 A * 7/1998 Koyama et al. ..... 400/193
6,500,259 B1 * 12/2002 Tamai et al. ..... 118/76
6,521,045 B1 * 2/2003 Koyama et al. ..... 118/257

FOREIGN PATENT DOCUMENTS

JP 9-104563 4/1997

* cited by examiner

*Primary Examiner*—Stephen R. Funk
*Assistant Examiner*—Marissa Ferguson
(74) *Attorney, Agent, or Firm*—Sughrue Mion, PLLC

(57) ABSTRACT

A film transfer apparatus includes a mechanism which is adapted to prevent a reverse rotation of a take-up reel (8) for a tape. The mechanism is formed of a check claw (29) and reverse rotation preventing teeth (30). The check claw and one of the teeth are engaged with each other firmly and reliably. When the check claw should be broken or deformed to cause the function thereof to become incomplete, only the member provided with the check claw needs to be renewed easily by a simple operation. A check pin (23) inserted from the outer side of a cartridge unit (2) into a cylindrical retainer shaft (20) on which the take-up reel is rotatably mounted is combined in one body rotationally with the take-up reel. The check pin is engaged in a reverse rotation preventing manner in a tightly winding direction with respect to the cartridge unit.

5 Claims, 7 Drawing Sheets

Fig. 8
Conventional
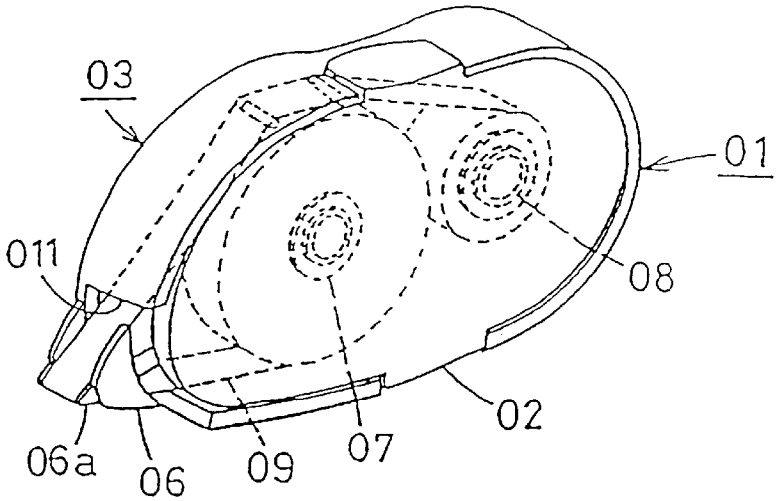
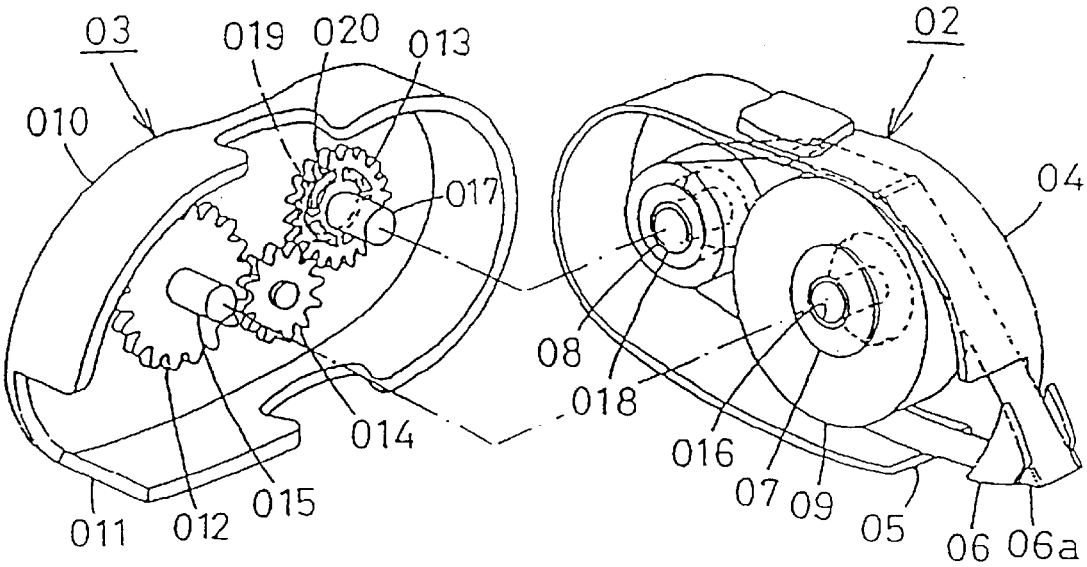
Fig. 9
Conventional

FILM TRANSFER APPARATUS

The following disclosure is based on Japanese Patent Application No. 2001-249348, filed on Aug. 20, 2001, which is incorporated into this application by reference.

FIELD OF AND BACKGROUND OF THE INVENTION

This invention relates to a film transfer apparatus and more particularly to an improvement in a non-return mechanism for a take-up reel of a film transfer apparatus of a type which is formed by combining a cartridge unit and a case body with each other. A feed reel and a take-up reel around which a transfer tape adapted to be reversed on a transfer head is wound are supported by the apparatus so that the two reels can be rotated relatively and smoothly irrespective of an increase and a decrease in the amounts of the transfer tape wound around the reels.

FIG. 8 is a perspective view of a typical conventional film transfer apparatus, and FIG. 9 an exploded view in perspective of the film transfer apparatus shown in FIG. 8.

The conventional film transfer apparatus 01 is provided with a cartridge unit 01 and a case body 03.

The cartridge unit 02 serves as a cover and is slightly laterally elongated, i.e., elliptic in a front elevation. The cartridge unit 02 is provided at one lateral end of a front side-opened, flat, case member 04 thereof with a cutout hole 05 as a window-like hole, from which a transfer head 06 is projected. In the case member 04, a feed reel 07 and a take-up reel 08 are provided laterally spaced from each other. A portion of a coiled transfer tape 09 wound around the feed reel 07 and drawn out therefrom is reversed at a tip 06*a* of the transfer head 06 and then taken up around the take-up reel 08.

The case body 03 is formed of a front-side opened, flat case member 010 having substantially the same contour in a front elevation as the cartridge unit 02, but the contour of the case body being slightly larger than that of the cartridge unit. The case member 010 is provided at one lateral end thereof with a cutout hole 011 as a window-like hole. In the interior of the case member, a feed gear 012 and a take-up gear 013 are arranged laterally spaced from each other, both meshing with an intermediate gear 014. These gears 012, 013 are adapted to be rotated in the same direction.

The positions, shapes and sizes of the two cutout holes 05, 011 are determined so that the cutout holes are aligned with each other when the cartridge unit 02 and the case body 03 are engaged with each other as will be described later.

To obtain the assembled film transfer apparatus 01, the cartridge unit 02 and case body 03 are disposed the open sides thereof opposite to each other, and a shaft 015 in the center of the feed gear 012 is inserted into a shaft cylinder 016 in the center of the feed reel 07 with a shaft 017 in the center of the take-up gear 013 into a shaft cylinder 018 in the center of the take-up reel 08. The transfer head 06 projects out from the cutout holes 05, 011 of the mutually aligned cartridge unit 02 and case body 03, and the cartridge unit 02 and case body 03 are thereby engaged with each other for forming one body.

In this film transfer apparatus 01, the shaft 015 in the center of the feed gear 012 and the shaft 017 in the center of the take-up gear 013 are inserted into the shaft cylinders 016, 018 of the feed reel 07 and take-up reel 08 respectively. The film transfer apparatus is operated as follows.

When the film transfer apparatus is moved rightward in FIG. 8 as the transfer head 06 is pressing against a surface of a sheet, the transfer tape 09 slides on the tip 06*a* of the transfer head 06 and a portion of the transfer tape 09 which is wound like a coil around the feed reel 07 is turned. A turning force is transmitted to the feed gear 012 via the shaft 015 inserted in the shaft cylinder 016 of the feed reel 07, and further to the take-up gear 013 operatively connected to the feed reel 07.

The turning force is then transmitted to the take-up reel 08 via the shaft 017 in the center of the take-up gear 013 and the shaft cylinder 018 in which the shaft 17 is inserted.

Owing to the turning force thus transmitted, the portion of the coiled transfer tape 09 on the feed reel 07 which is drawn therefrom is reversed at the tip 06*a* of the transfer head 06 and then taken up around the take-up reel 08.

To be precise, in an initial stage of a film transfer operation, the diameter of the coiled transfer tape 09 on the feed reel 07 is large, and that portion thereof taken up around the take-up reel 08 is small. However, as the transfer tape is used, the diameters of the coiled transfer tape on the feed reel 07 and take-up reel 08 are gradually reversed.

A compensation of the differing rotation ratio of the feed reel 07 to the take-up reel 08 is made by interposing a resistance member, for example, a suitable spring and a ring-shaped material between the shaft cylinder 016 of the feed reel 07 and the shaft 015 in the center of the feed gear 012, or between the shaft cylinder 018 of the take-up reel 08 and the shaft 017 in the center of the take-up gear 013 so that the shafts 015, 017 and shaft cylinders 016, 018 are rotated relatively with a low resistance generated therebetween.

In order that an operator cannot move the film transfer apparatus reversely, a reverse rotation preventing mechanism is usually provided on the take-up reel 08 so that the transfer tape 09 is not drawn from the take-up reel 08, and shaking of the apparatus during a transfer tape operation does not cause the transfer tape 09 on the take-up reel 08 to be turned back.

As a device for preventing a reverse rotation of the take-up reel 08, a ratchet mechanism is disclosed, for example, in the Japanese patent laid-open document No. 104563/1997.

Namely, in the conventional apparatus according to FIGS. 8 and 9, a reverse rotation preventing annular toothed member 019 coaxial with the take-up gear 013 combined in one body with the shaft 017 supporting the take-up reel 013, and an elastic plate type claw member 020 directed from a suitable portion of the take-up gear 013 toward the annular toothed member 019 are provided on an inner surface of the case body 03, the claw member 020 being engaged with the annular toothed member 019 in a reverse rotation preventing manner.

However, when the annular toothed member 019 or the plate type claw member 020 of this conventional reverse rotation preventing mechanism are worn out or bent as these parts are used, resulting in that the functions thereof becoming incomplete, it is necessary to remove the cartridge unit 02 from the case body 03, renew the case body 03 combined with the annular toothed member 019 in one body, or the take-up gear 013 provided with the claw member 020, and then put the case body 03 and cartridge unit 02 together again.

Such operations are troublesome and need delicate carefulness, and various parts scatter and move. Therefore, a user cannot carry out such operations easily at all.

OBJECTS OF THE INVENTION

The present invention has been made to overcome the above-mentioned inconveniences. Namely an object of the invention is to provide a film transfer apparatus having a mechanism which is adapted to prevent a reverse rotation of a transfer tape-wound take-up reel and includes a check claw and check teeth, in which the check claw and one of the check teeth can be engaged with each other firmly and reliably. Another object of the invention is to provide a film transfer apparatus in which only the check claw member-carrying parts need to be renewed which can be done easily by a simple operation when the check claw should be broken or deformed resulting in that the functions thereof become incomplete.

SUMMARY OF THE INVENTION

These and other objects are solved in accordance with the present invention by a film transfer apparatus which comprises a cartridge unit and a case body adapted to be combined with said cartridge unit, and including a feed reel and a take-up reel supported on the case body, around which a transfer tape adapted to be reversed on a transfer head is wound, these reels can be rotated relatively and smoothly irrespective of an increase and a decrease in the amounts of the transfer tape wound around the two reels, and a reverse rotation preventing mechanism. Said mechanism comprises a check pin inserted from the outer side of the cartridge unit into a cylindrical retainer shaft on which the take-up reel is rotatably mounted, combined in one body rotationally with the take-up reel, and engaged in a reverse rotation preventing manner in a tightly winding direction with respect to the cartridge unit.

According to an embodiment of the invention the check pin can be provided on an outer circumferential portion of a free end thereof with a slip-off preventing projection capable of being engaged with a shaft hole of the take-up reel supported rotatably on the case body.

According to another embodiment of the invention an outer circumferential surface of the check pin and an inner circumferential surface of the shaft hole of the take-up reel can be provided with axially extending locking ribs engageable with each other in a rotational direction thereof.

Still according to another embodiment of the invention the cylindrical retainer shaft on which the take-up reel in the cartridge unit is rotatably mounted can be provided on an inner circumferential surface thereof with teeth extending in one circumferential direction thereof, the check pin being provided at the portion of an outer circumferential surface thereof which is opposed to the teeth with a check or locking claw engageable with one of the teeth in a predetermined direction only.

Finally according to another embodiment of the invention the check pin can be withdrawn from the cartridge unit by a screw driver.

BRIEF DESCRIPTION OF THE DRAWINGS

The invention as well as embodiments and advantages thereof will now be described with greater detail with reference to the drawings, in which:

FIG. 8 is a perspective view showing an example of a conventional film transfer apparatus; and FIG. 9 is a perspective view showing a cartridge unit and a case body in a separated state of the conventional apparatus of FIG. 8.

DETAILED DESCRIPTION OF PREFERRED EMBODIMENTS

Figure 1:
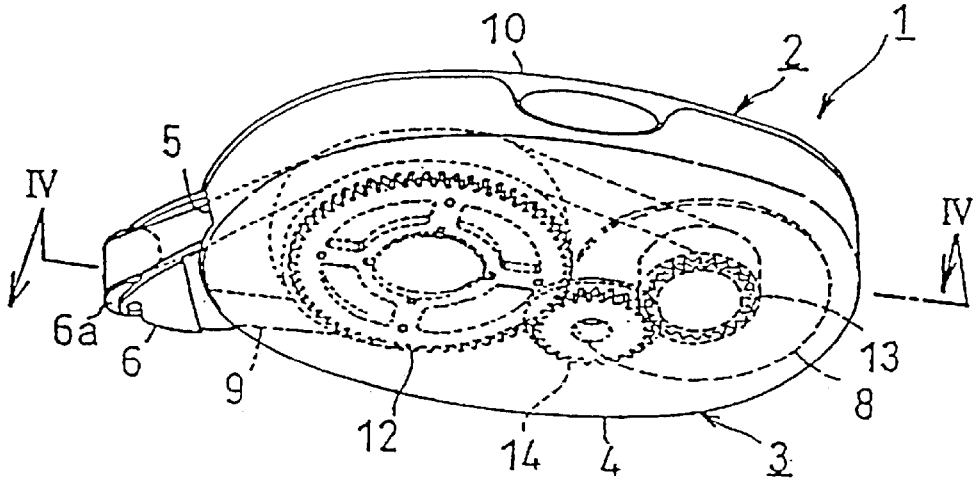
FIG. 1 is an external view in perspective showing a film transfer apparatus according to an embodiment of the present invention.
Figure 2:
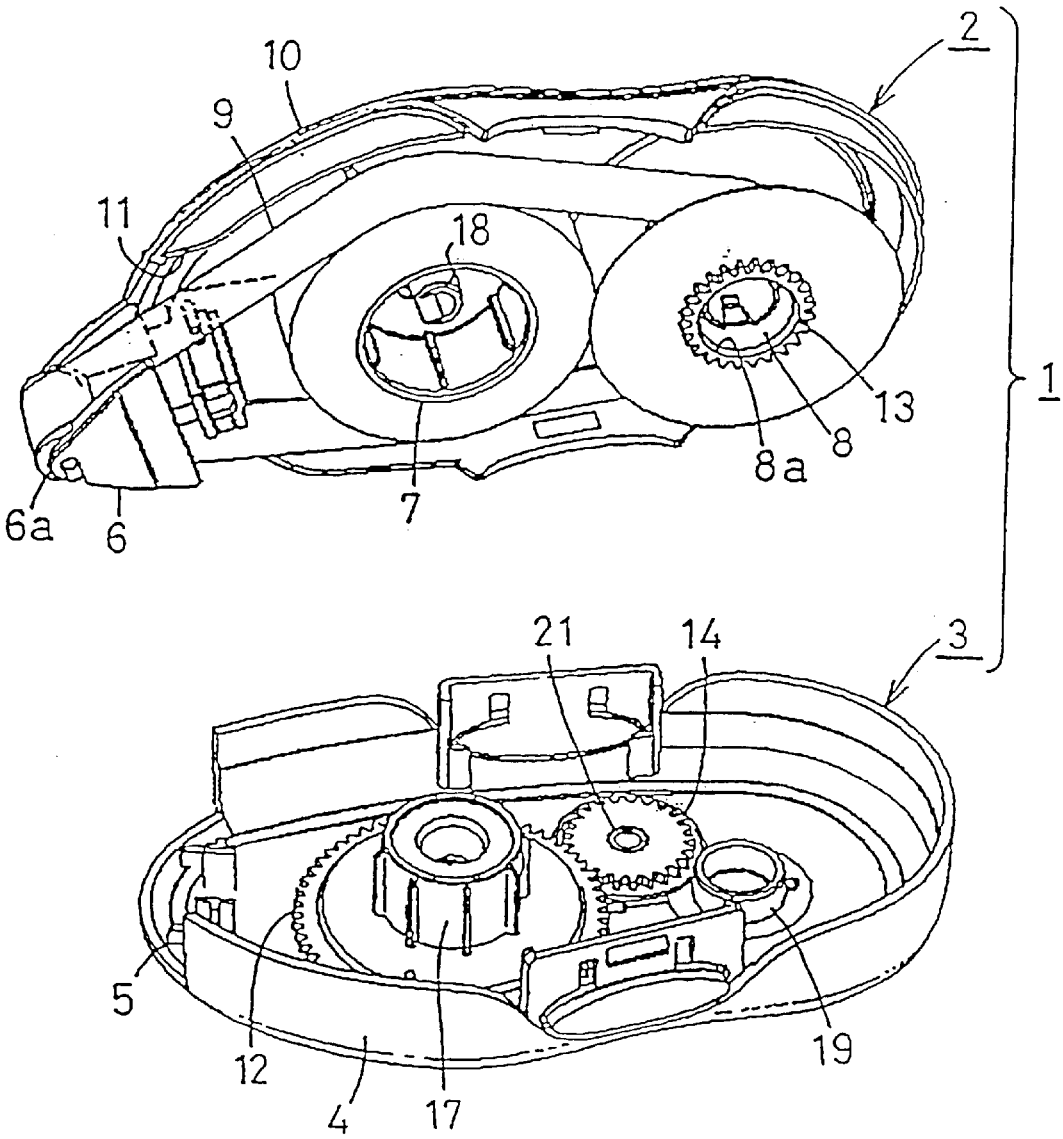
FIG. 2 is a perspective view showing the film transfer apparatus according to FIG. 1 with a cartridge unit and a case body thereof separated from each other.
Figure 3:
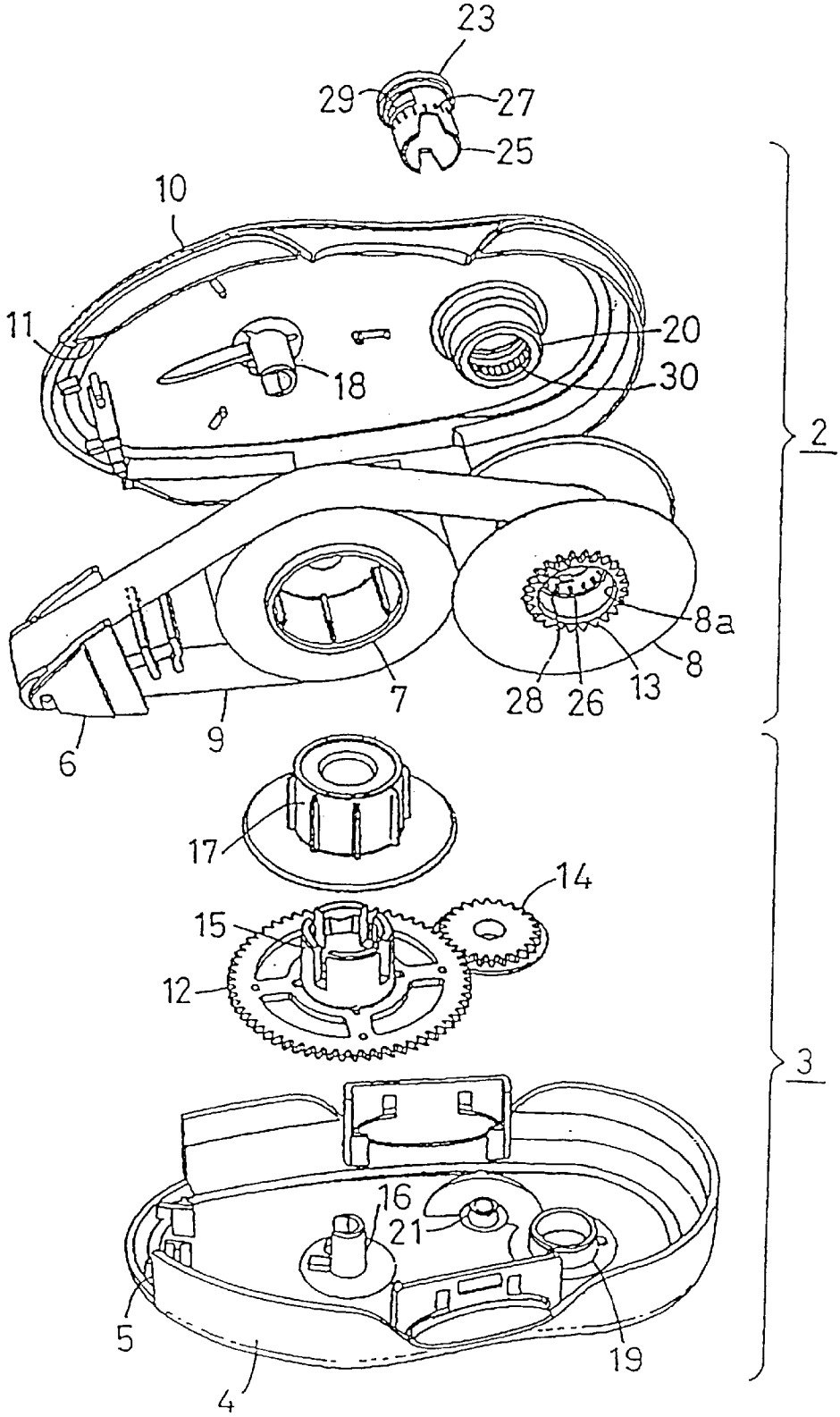
FIG. 3 is an exploded perspective view of the cartridge unit and case body shown in FIG. 2.
Figure 4:
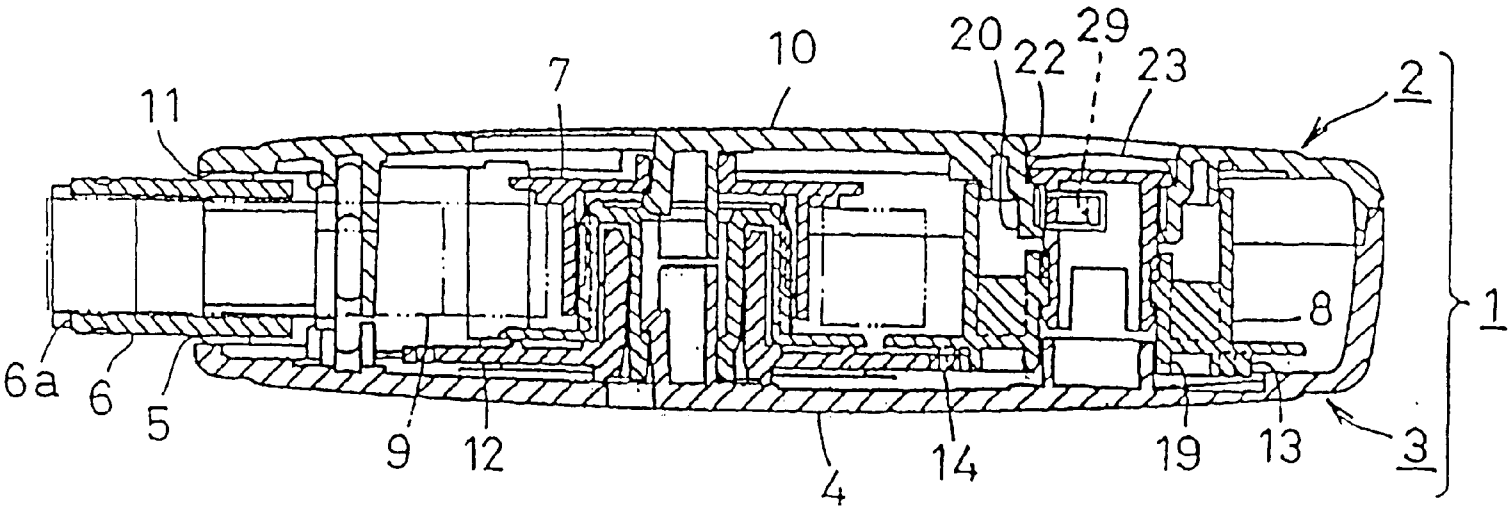
FIG. 4 is a longitudinal sectional view taken along the line IV—IV in FIG. 1.
Figure 5:
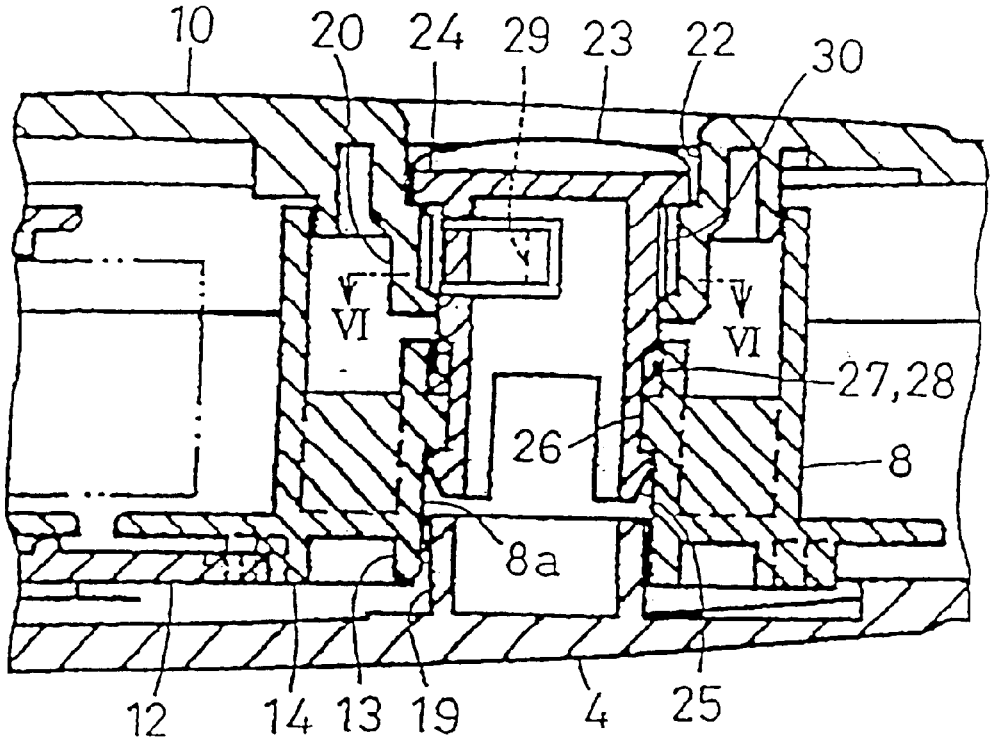
FIG. 5 is an enlarged view of a principal portion of what is shown in FIG. 4.
Figure 6:
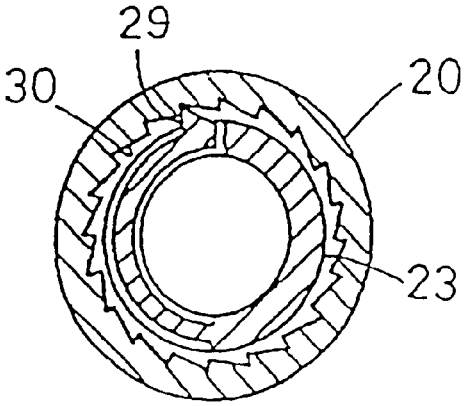
FIG. 6 is a horizontal sectional view taken along the line VI—VI in FIG. 5.
Figure 7:
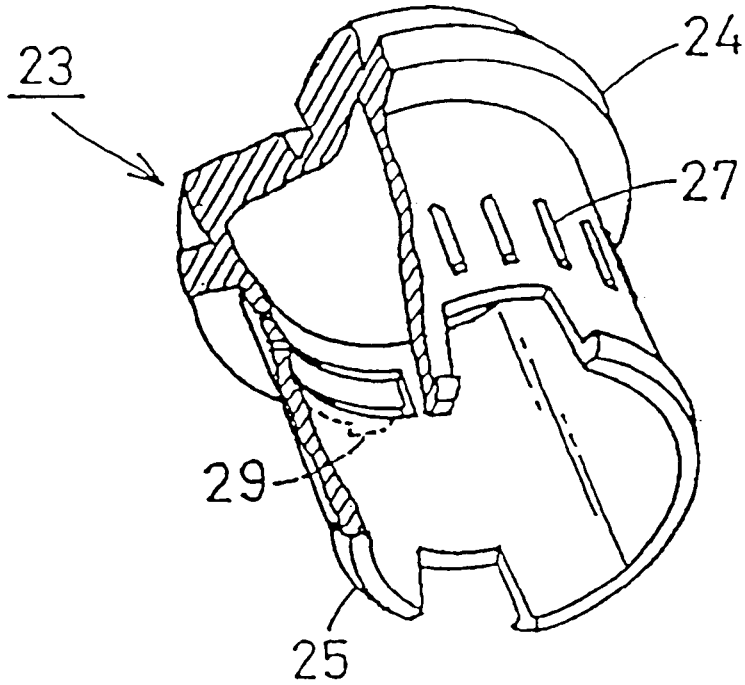
FIG. 7 is a perspective view of a check pin shown in each of the above drawings.

FIGS. 1–7 show an embodiment of the present invention. A basic portion of this embodiment does not fundamentally differ from that of the conventional apparatus shown in FIGS. 8 and 9, except for a mechanism for preventing a reverse rotation of a take-up reel. Therefore, the parts of the present embodiment which are identical with those shown in FIGS. 8 and 9 are designated by same reference numerals but numeral „0" has been omitted.

In this embodiment, a feed gear 12 has a cylindrical shaft 15 in the center thereof. The cylindrical shaft 15 is fitted rotatably around a cylindrical support shaft 16 projecting from rather the left-of-center of an inner surface of a case member 4 of a case body 3.

An intermediate cylinder 17 is fitted around the cylindrical shaft 15, and a feed reel 7 is fitted around and supported on the intermediate cylinder 17. An outer end portion is supported rotatably on a support shaft 18 projecting from the inner surface of the case member 10 of the cartridge unit 2.

A front end portion of a shaft hole 8*a* of a take-up reel 8 is fitted around a short cylindrical shaft 19 projecting from rather the right-of-center of the inner surface of the case member 4 of the case body 3, while an outer end portion of the shaft hole is fitted around and supported on a retainer shaft 20 projecting from the inner surface of the case member 4 cartridge unit 2.

An intermediate gear 14 is fitted around a mount shaft 21 projecting from the portion of the inner surface of the case member 4 which is between the cylindrical support shaft 16 and the retainer shaft 20. The intermediate gear 14 meshes with the feed gear 12 and take-up gear 13.

The feed reel 7 is adapted to be rotated with a low resistance with respect to the support shafts 16, 18 in the same manner as that of the conventional apparatus. Since details of the feed reel are not in a direct relation with the present invention, a detailed description thereof is omitted.

A mechanism for preventing a reverse rotation of the take-up reel 8, which constitutes the characteristic feature of the present invention will now be described.

According to the present invention, the reverse rotation preventing mechanism is formed of number of check teeth provided on the inner surface of the take-up gear, and a check pin capable of being inserted into and withdrawn from the case body, instead of, for example, the plate type claw member 020 projected from the take-up gear 013, and the annular tooth 019 provided on the case body 03 according to the conventional mechanism. The reverse rotation mechanism in the present invention is designed so as to solve the above-mentioned problems involved with the conventional reverse rotation preventing mechanism.

A front end portion of the take-up reel 8 is fitted rotatably around the short cylindrical shaft 19 of the case body 3, and the cartridge unit 2 in the case body 3, the case body and cartridge unit being then combined with each other suitably by screws. The retainer shaft 20 in the cartridge unit 2 is thereby opposed coaxially with a front end surface of the short cylindrical shaft 19.

A check pin 23 is then inserted from a stepped hole 22, which is provided in the cartridge unit 2 coaxially with the retainer shaft 20, and a diametrically enlarged head portion 24 of the check pin is engaged with the stepped hole 22 with an outwardly directed claw 25 at a front end of the check pin 23 engaging a lower surface of a slip-off preventing projection 26 provided on an inner surface of the take-up reel 8.

Owning to this arrangement, the take-up reel 8 is retained in the cartridge 2 via the check pin 23 in a slip-off preventing manner.

In this structure, axially extending locking ribs 27 provided on a required portion of an outer circumferential surface of the check pin 23 are engaged with axially extending locking ribs 28 provided one an inner circumferential surface of the take-up reel 8, and these two sets of locking ribs are thereby united rotationally. A check claw 29 provided on a neck portion of the outer circumferential surface of the check pin 23, projecting in the radial direction and extending in one circumferential direction is meshed with one of the cylindrically arranged teeth 30 provided on the whole inner circumferential surface of the retainer shaft 20 of the cartridge unit 2, and the check pin 23 is thereby held so that the check pin cannot be reversely rotated.

Accordingly, the take-up reel 8 is held non-reversely-rotatably via the check pin 23 with respect to the cartridge unit 2 and case body 3.

The objects and effects obtained by the construction mentioned above will be described as follows.

After the cartridge unit and case body are combined with each other, or, when these parts are combined with each other, the check pin 23 is inserted from the stepped hole 22, which is provided in the cartridge unit 2. The front end portion of the check pin 23 is thereby engaged in a slip-off preventing manner with the take-up reel 8 supported rotatably in the case body. In addition, the axially extending locking ribs 29 provided, for example, on the check pin 23 and in the shaft hole of the take-up reel 8 are engaged with one another, thereby the check pin and the take-up reel are united rationally. Therefore, incorporating the reverse rotation preventing mechanism into the film transfer apparatus can be done simply.

An outwardly extending slip-off preventing projection is provided on the front end of the check-pin 23, and the check pin 23 is inserted from the outer side of the cartridge toward the case body 3. As a result, the slip-off preventing projection is engaged automatically with the locking projection provided in the shaft hole of the take-up reel supported rotatably on the case body, and the cartridge unit and case body are held in a combined state. The front end portion of the take-up reel is also supported firmly and stably owing to the check pin.

Since the outer circumferential surface of the check pin and the inner circumferential surface of the shaft hole of the take-up reel are provided with axially extending locking ribs respectively which can be engaged with one another in the circumferential direction, the check pin and the take-up reel are united rotationally by only inserting the former into the latter. Therefore, it becomes simple to carry out the assembling and disassembling of these parts.

Since the reverse rotation preventing check teeth extending in a predetermined direction are provided on the inner circumferential surface of the retainer shaft with the check claw provided on the outer circumferential surface of the check pin, the contact areas of one of these teeth and the check claw become remarkably large as compared with those of the conventional combination shown in FIGS. 8 and 9 of the locking claw, which is formed of the front end portion of the bent member, and annularly arranged teeth. Accordingly, the engagement of a check tooth with the check claw becomes firm and reliable, and the durability of these parts high. This minimizes a fear of the occurrence of a breakage of these parts.

When the degree of engagement or the shape of each locking part is determined in advance so that the check pin is disengaged from the retainer shaft and the shaft hole of the take-up reel by inserting a free end portion of a screw driver under a lower surface of the diametrically enlarged head portion of the check pin and then forcing up the same head portion, the check pin can be renewed easily when the locking parts are worn out or deformed.

The above description of the preferred embodiments has been given by way of example. From the disclosure given, those skilled in the art will not only understand the present invention and the attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A film transfer apparatus comprising a cartridge unit (2) and a case body (3), including a feed reel (7) and take-up reel (8) around which a transfer tape adapted to be reversed on a transfer head (6) is wound, said reels being supported via shafts on said case body (3) so that the reels can be rotated relatively and smoothly irrespective of an increase and a decrease in the amounts of the transfer tapes wound around the reels, and a reverse rotation preventing mechanism, said reverse rotation preventing mechanism comprising a check pin (23) inserted from an outer side of the cartridge unit (2) into a cylindrical retainer shaft (20) on which the take-up reel is rotatably mounted, combined in one body rotationally with the take-up reel (8), and engaged in a reverse rotation preventing manner in a tightly winding direction with respect to the cartridge unit.

2. A film transfer apparatus according to claim 1, wherein the check pin (23) is provided on an outer circumferential portion of a free end thereof with a slip-off preventing projection (26) capable of being engaged with a shaft hole (22) of the take-up reel (8) supported rotatably on the case body (3).

3. A film transfer apparatus according to claim 1, wherein an outer circumferential surface of the check pin (23) and an inner circumferential surface of the shaft hole (22) of the take-up reel (8) are provided with axially extending locking ribs (27,28) engageable with one another in a rotational direction thereof.

4. A film transfer apparatus according to claim 1, wherein the cylindrical retainer shaft (20) on which the take-up-reel (8) in the cartridge unit (2) is rotatably mounted is provided on an inner circumferential surface thereof with a plurality of teeth (30) extending in one circumferential direction thereof, said check pin (23) being provided at the portion of an outer circumferential surface thereof which is opposed to the teeth with a check claw (24) engageable with one of the teeth in a predetermined direction alone.

5. A film transfer apparatus according to claim 1, wherein the check pin (23) is made able to be withdrawn from the cartridge unit (2) by a screw driver.

* * * * *